US010054406B2

(12) United States Patent
Burky et al.

(10) Patent No.: US 10,054,406 B2
(45) Date of Patent: Aug. 21, 2018

(54) REACTIVE SEMICONDUCTOR BRIDGE WITH OXIDE OVERCOAT

(71) Applicant: BATTELLE MEMORIAL INSTITUTE, Columbus, OH (US)

(72) Inventors: Thomas E. Burky, Mansfield, TX (US); Jeffrey P. Carpenter, Lancaster, OH (US); Laura Dues, Dublin, OH (US)

(73) Assignee: BATTELLE MEMORIAL INSTITUTE, Columbus, OH (US)

( * ) Notice: Subject to any disclaimer, the term of this patent is extended or adjusted under 35 U.S.C. 154(b) by 0 days.

(21) Appl. No.: 15/274,027

(22) Filed: Sep. 23, 2016

(65) Prior Publication Data

US 2017/0010078 A1 Jan. 12, 2017

Related U.S. Application Data

(63) Continuation of application No. PCT/US2015/022130, filed on Mar. 24, 2015.

(Continued)

(51) Int. Cl.
*F42B 3/13* (2006.01)
*F42B 3/12* (2006.01)

(52) U.S. Cl.
CPC ..... *F42B 3/13* (2013.01); *F42B 3/128* (2013.01)

(58) Field of Classification Search
CPC .... F42B 3/12; F42B 3/13; F42B 3/124; F42B 3/125; F42B 3/127; F42B 3/128; F42B 3/11; F42D 1/045

(Continued)

(56) References Cited

U.S. PATENT DOCUMENTS 6,772,692 B2 * 8/2004 Baginski ..... F42B 3/13 102/202.7
6,810,815 B2 * 11/2004 Mueller-Fiedler ..... F42B 3/124 102/202.5

(Continued)

FOREIGN PATENT DOCUMENTS

WO WO2006058349 A1 6/2006

OTHER PUBLICATIONS

Notification Concerning Transmittal of International Preliminary Report on Patentability and the Written Opinion of the International Searching Authority for International Application No. PCT/US2015/022130; The International Bureau of WIPO; Geneva, Switzerland; dated Oct. 6, 2016.

(Continued)

*Primary Examiner* — James S Bergin
(74) *Attorney, Agent, or Firm* — Thomas E. Lees LLC

(57) ABSTRACT

A device comprises a reactive semiconductor bridge including a conductive metal, a reactive material, and an overcoat. When a high current passes through the reactive semiconductor bridge, the conductive metal vaporizes into a high temperature plasma. The reactive material is coupled to the conductive metal such that the conductive metal experiences an exothermic reaction to the plasma. When the conductive metal turns to plasma, the overcoat material absorbs at least a part of the exothermic reaction of the reactive material and breaks into a plurality of particles that are propelled away from the bridge. A gap is disposed between the overcoat and a membrane, and an explosive material couples to the membrane. The plurality of particles crosses the gap and penetrates the membrane to ignite the explosive material in response to being propelled away from the bridge.

13 Claims, 3 Drawing Sheets

Related U.S. Application Data

(60) Provisional application No. 61/969,696, filed on Mar. 24, 2014.

(58) Field of Classification Search
USPC ..... 102/202.5, 202.7; 361/248
See application file for complete search history.

(56) References Cited

U.S. PATENT DOCUMENTS

| | | | | |
|---|---|---|---|---|
| 6,925,938 | B2 * | 8/2005 | Baginski | F42B 3/13 102/202.5 |
| 8,934,214 | B2 * | 1/2015 | Barker | F42B 3/13 361/248 |
| 9,021,954 | B2 * | 5/2015 | Morris | F42B 3/12 102/202.7 |
| 9,581,419 | B2 * | 2/2017 | Barker | F42B 3/13 |
| 2003/0192445 | A1 | 10/2003 | Baginski et al. | |
| 2004/0261645 | A1 * | 12/2004 | Martinez-Tovar | F42B 3/13 102/202.9 |
| 2013/0133542 | A1 | 5/2013 | Morris et al. | |

OTHER PUBLICATIONS

International Search Report and the Written Opinion of the International Searching Authority for International Application No. PCT/US2015/022130; European Patent Office; Rijswijk, Netherlands; Jun. 16, 2015.

* cited by examiner

REACTIVE SEMICONDUCTOR BRIDGE WITH OXIDE OVERCOAT

CROSS REFERENCE TO RELATED APPLICATIONS

This application is a continuation of International Application No. PCT/US2015/022130, filed Mar. 24, 2015, entitled REACTIVE SEMICONDUCTOR BRIDGE WITH OXIDE OVERCOAT, which claims the benefit of U.S. Provisional Patent Application Ser. No. 61/969,696, filed Mar. 24, 2014, entitled REACTIVE SEMICONDUCTOR BRIDGE WITH OXIDE OVERCOAT, the disclosures of which are hereby incorporated herein by reference.

BACKGROUND

Various aspects of the present disclosure relate generally to electro-explosive devices, and more specifically, to electro-explosive devices such as solid state initiators with a reactive semiconductor bridge.

An electro-explosive device is a device that is designed to produce an exothermic reaction when activated by the application of a suitable electrical energy signal. Typically, the exothermic reaction is produced by converting chemical energy into a mechanical shock wave, combustion, deflagration, explosion, or combination thereof, which serves as the initiation of an event. As a few examples, an electro-explosive device can be used to initiate a pyrotechnic compound, e.g., to deploy an airbag in an automobile. An electro-explosive device can also be used to initiate a mechanical shock wave and/or a deflagration or other exothermic event to function an explosive, e.g., for mining, drilling, excavating, and other blasting operations.

BRIEF SUMMARY

According to aspects of the present disclosure, a reactive semiconductor bridge comprises a pair of electrically conductive pads spaced apart and electrically connected by a bridge portion. The reactive semiconductor bridge also comprises a reactive material and an overcoat. The reactive material is positioned over the bridge portion such that, in response to the bridge portion turning to plasma, the reactive material experiences an exothermic reaction. The overcoat is positioned over the reactive material and includes a layer of material such that in response to the bridge portion turning to plasma, the layer of material absorbs at least a part of the exothermic reaction of the reactive material and breaks into particles having sufficient mass to penetrate a membrane spaced from the reactive semiconductor bridge by a gap.

According to further aspects of the present disclosure, an apparatus, e.g., for functioning an explosive material, comprises a reactive semiconductor bridge device and a membrane spaced from the reactive semiconductor bridge device by a gap. The reactive semiconductor bridge device includes a pair of electrically conductive pads spaced apart and electrically connected by a bridge portion. Additionally, a reactive material is provided over the bridge portion such that, in response to the bridge portion turning to plasma, the reactive material experiences an exothermic reaction. Further, an overcoat is provided over the reactive material. The overcoat includes a layer of material, e.g., silicon dioxide, such that in response to the bridge portion turning to plasma, the layer of material absorbs at least a part of the exothermic reaction of the reactive material and breaks into particles, e.g., possibly molten glass fragments in the case of silicon dioxide, which are propelled away from the bridge portion such that at least one particle has sufficient mass to cross through the gap and penetrate the membrane.

In this regard, the apparatus may also include an explosive material on an opposite side of the membrane as the gap. Here, upon functioning the reactive semiconductor bridge device to turn the bridge portion to plasma, at least one particle crosses the gap and penetrates the membrane that has sufficient energy to function the explosive material.

According to yet further aspect of the present disclosure, an apparatus comprises a reactive semiconductor bridge, a membrane spaced from the reactive semiconductor bridge by a gap, and an explosive material. The reactive semiconductor bridge includes a conductive metal, such that when a high current passes through the reactive semiconductor bridge, the conductive metal vaporizes into a high temperature plasma. A reactive material is coupled to the conductive metal such that the conductive metal experiences an exothermic reaction to the plasma. Moreover, an overcoat is provided over the reactive material. The overcoat includes a layer of material, e.g., an oxide or other material, such that when the conductive metal turns to plasma, the layer of material absorbs at least a part of the exothermic reaction of the reactive material and breaks into a plurality of particles that are propelled away from the bridge. The gap is disposed between the overcoat and a membrane. Moreover, the explosive material is coupled to an opposite side of the membrane as the gap. Upon functioning the apparatus, the plurality of particles crosses through the gap and penetrates the membrane to ignite the explosive material in response to being propelled away from the bridge.

According to yet further aspects of the present disclosure, a reactive semiconductor bridge includes a conductive metal, a reactive material and an overcoat. The conductive metal is configured such that when a high current passes through the reactive semiconductor bridge, the conductive metal vaporizes into a high temperature plasma. The reactive material is coupled to the conductive metal such that the conductive metal experiences an exothermic reaction to the plasma. The overcoat includes a layer of material such that when the conductive metal turns to plasma, the layer of material absorbs at least a part of the exothermic reaction of the reactive material and breaks into a plurality of particles that are propelled away from the bridge.

According to yet further aspects of the present disclosure, a method of initiating an explosive event comprises receiving by a reactive semiconductor bridge device, an initiating voltage signal. Here, the reactive semiconductor bridge device includes a pair of electrically conductive pads spaced apart and electrically connected by a bridge portion, a reactive layer over the bridge portion and an overcoat over the reactive layer. Moreover, the initiating voltage signal is received across the pair of contact pads. The method also comprises converting the received voltage into a high current passing through the bridge portion so as to vaporize the bridge portion into a high-temperature plasma. The method still further comprises forcing an exothermic reaction in the reactive layer in response to the plasma, whereby the reactive layer gets at least partially absorbed in the overcoat so as to break the overcoat into a plurality of particles that are propelled away from the bridge portion. For instance, the overcoat may include a strong-bonded oxide layer, such that the strong-bonded oxide layer breaks into a plurality of particles, e.g., molten glass fragments, that are propelled by the exothermic reaction away from the bridge portion.

The method may also further comprise propelling the particles across a gap to penetrate a membrane with sufficient energy to function an explosive material positioned on the opposite side of the membrane as the air gap.

DETAILED DESCRIPTION

According to various aspects of the present disclosure, an apparatus includes an electro-explosive device in the form of a reactive semiconductor bridge device (RSCB) that is separated from a membrane by a gap. In illustrative implementations, an explosive material is located on the opposite side of the membrane as the gap. In operation, functioning the apparatus causes the discharge of particles that travel through the gap. The particles have sufficient thermal mass and retain enough energy while they transit the gap to penetrate the membrane and initiate an explosive train in the explosive material.

As will be described in greater detail herein, the reactive semiconductor bridge includes an overcoat. When the reactive semiconductor bridge is functioned, the overcoat breaks into many energetic particles (e.g., pieces of material) of sufficient mass and energy to cross the gap to initiate the explosive. In an illustrative example, the overcoat includes silicon dioxide. In this example, upon functioning the reactive semiconductor bridge device, the overcoat breaks into pieces, which may include molten particles of glass, which get launched through the gap and pierce the membrane to activate the explosive material. However, other materials can be utilized to form the overcoat.

As such, aspects of the present disclosure herein allow reactive semiconductor bridge devices and corresponding circuits to be used in devices such as initiators, detonators, inflators, igniters, etc., with relaxed manufacturing tolerances while retaining the advantages inherent to reactive semiconductor bridge device-type electronic initiators such as high reliability and precise timing.

Figure 1:
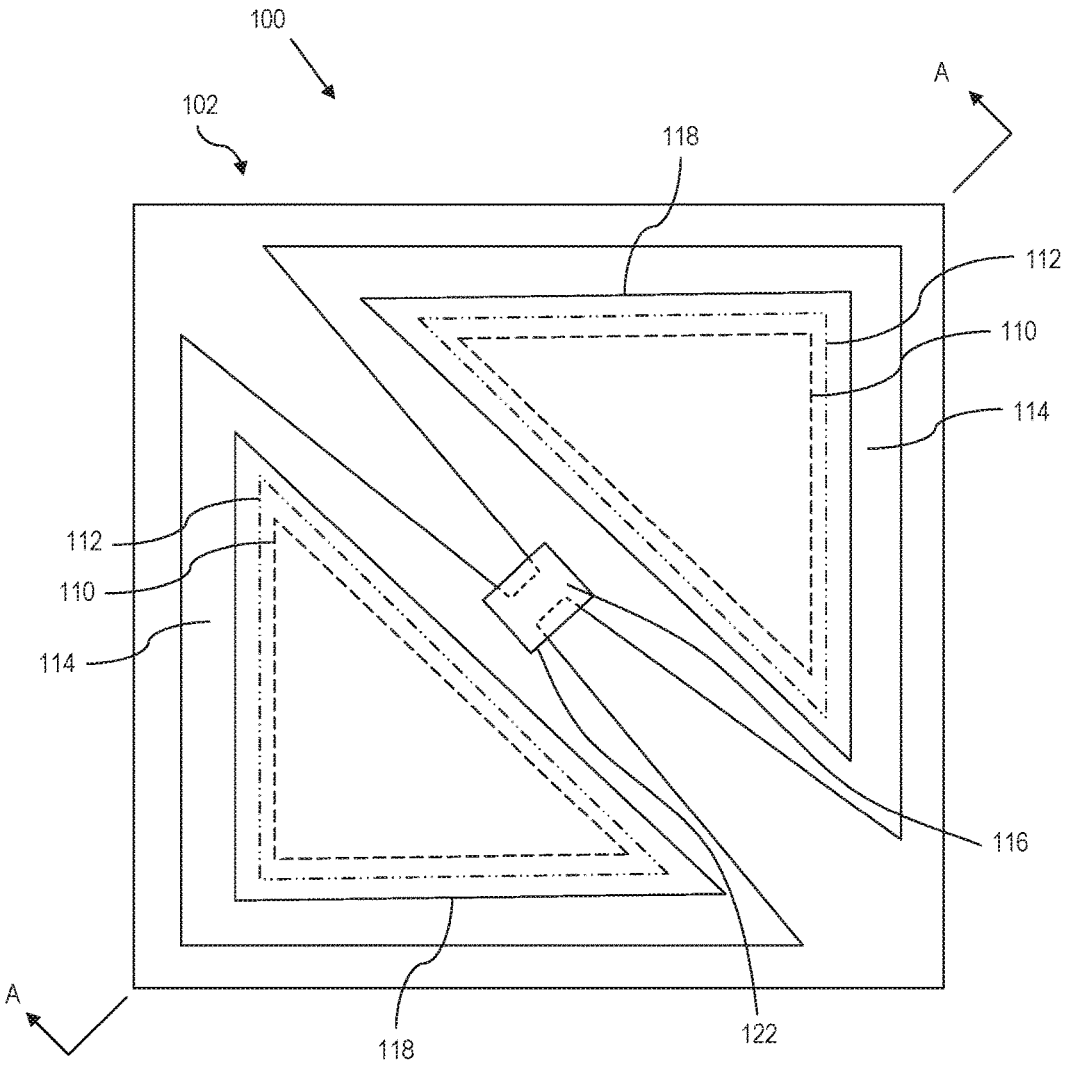
FIG. 1 is a top view of a reactive semiconductor bridge with an overcoat, according to various aspects of the present disclosure.
Figure 2:
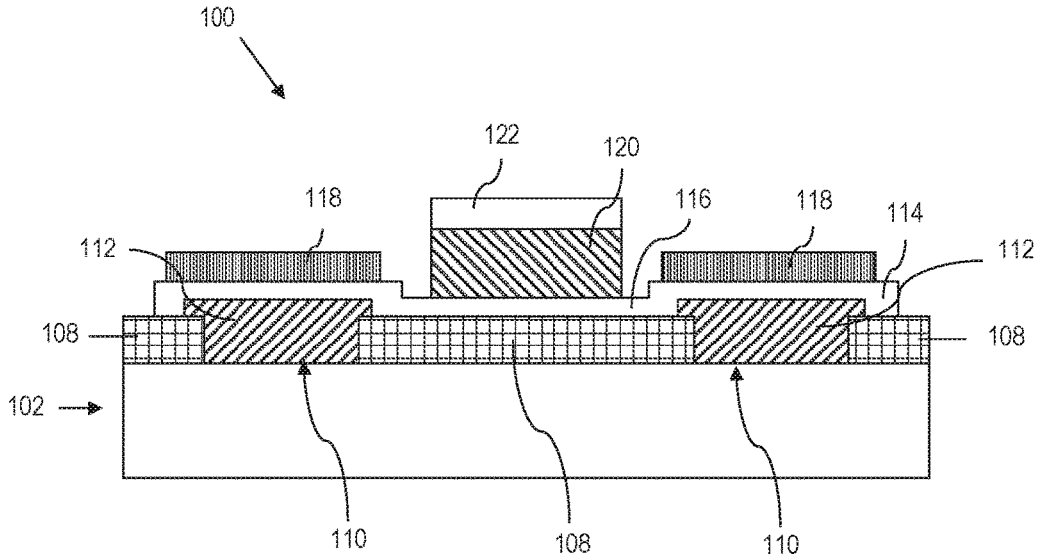
FIG. 2 is a cutout view along line A of the reactive semiconductor bridge with an overcoat of FIG. 1, according to various aspects of the present disclosure.

Referring to drawings, and particularly to FIGS. 1 and 2, an exemplary implementation of an electro-explosive device in the form of a reactive semiconductor bridge device 100 is shown. The reactive semiconductor bridge device 100 includes a base substrate 102. In exemplary implementations, the base substrate 100 may comprise a chip substrate such as alumina or silicon. In other exemplary implementations, such as where electrostatic discharge protection is desired on the chip itself, the substrate 102 may include a silicon substrate having doped wells and doped regions defining N—P—N or P—N—P structures underneath the reactive bridge semiconductor device.

As illustrated, a non-conducting layer 108 (see FIG. 2) is positioned over the base substrate 102. For instance, a layer of silicon dioxide ($SiO_2$) may be thermally grown on the base substrate 102. As another example, a layer of silicon dioxide ($SiO_2$) may be deposited over the base substrate 102.

In the illustrative implementation, windows 110 are formed in the non-conducting layer 108. For instance, where silicon dioxide is utilized to implement the non-conducting layer 108, the windows 110 can be formed by etching the silicon dioxide layer 108 using any suitable technique, e.g., buffered oxide etch (BOE). Alternatively, the silicon dioxide layer 108 may be deposited on the substrate 102 so as to create the windows 110. Still further, where electrostatic protection is desired, doping of the substrate 102 may be performed by ion implantation after the windows 110 have been formed, thus providing precise registration of the windows 110 and the doped regions.

The windows 110 may optionally be filled with a first electrically conductive material 112. For instance, the windows 110 may be filled by sputtering aluminum or aluminum/silicon (e.g., 1.2 microns), into the windows 110. Other materials may alternatively be utilized. Additionally, further processing may be required, e.g., masking, etching, heating, etc., and other techniques may be utilized to deposit the first electrically conductive material 112 into the windows 110.

In an illustrative implementation, a method of assembling the reactive semiconductor bridge device 100 includes forming the first electrically conductive material 112 as two isolated areas of conductive material 112. With reference to FIG. 1, at this stage in the assembly, the first electrically conductive material 112 forms two triangular shapes that overlie and are slightly larger than their corresponding window 110. However, as best seen with reference to FIG. 2, the two areas of electrically conductive material 112 are spaced apart from each other.

A layer 114 of conductive metal (e.g., 0.2 microns) is formed over the substrate 102 to define a bridge structure. More particularly, the layer 114 of conductive metal defines a bridge portion 116 that spans between widened areas of the layer 114 that overlie the two windows 110. In illustrative implementations, the layer 114 of conductive metal may comprise palladium, titanium, aluminum, a combination thereof, etc. As an example, the layer 114 of conductive metal may comprise a combination of titanium and palladium that is shaped in a bow-tie formation to create the bridge portion 116 (e.g., 15-40 microns$^2$) as a narrowing point between the portions of the layer 114 of conductive metal over the corresponding windows 110 (and corresponding first conductive layer 112 where optionally provided). Thus, in implementations where the optional first electrically conductive material 112 is utilized, the layer 114 of conductive metal may cover the first electrically conductive material 112. The layer 114 of conductive metal may be formed using suitable techniques, e.g., masking, developing, depositing, liftoff, etc.

Depending upon the material selected for the layer 114 of conductive metal, and the interfacing requirements, the relatively wide portions of the layer 114 of conductive metal that flank the bridge portion 116 (e.g., the portions of the layer 114 of conductive material that overlie the windows 110) can function as contact pads with the bridge portion 116 therebetween.

For instance, in an illustrative example, the layer 114 of conductive metal is a titanium layer. The titanium layer may not require separate contact pads. Moreover, the titanium can be the first conductive layer formed over the substrate 102, thus avoiding the need for a separate step to deposit aluminum or another material into the windows 110.

In alternative configurations, separate contact pads 118 (e.g., 0.2-0.35 microns) are optionally formed over the layer 114 of conductive metal such that a contact pad 118 aligns over (in register with) a corresponding window 110. In illustrative implementations, the contact pads 118 may be constructed from materials such as titanium, nickel, gold, combinations thereof, etc. Moreover, the contact pads 118 may be deposited on top of the layer 114 of conductive metal using suitable techniques, e.g., masking, developing, depositing, liftoff, etc.

In the example as illustrated, as best illustrated in FIG. 2, the contact pads 118 do not overlie the bridge portion 116 of the layer 114 of conductive metal. Moreover, as best illustrated in FIG. 1, the contacts 118 do not extend to the edges of the layer 114 of conductive metal. However, alternative configurations and arrangements may be utilized, e.g., depending upon the desired electrical properties of the reactive semiconductor bridge device 100. Moreover, as noted above, separate contact pads 118 are not required where contact pads can be implemented directly in the layer 114 of conductive material, e.g., titanium.

As will be described in greater detail herein, to function the reactive semiconductor bridge device 100, a sufficient voltage differential is placed across the contact pads 118 to cause enough current to flow through the bridge portion 116 to vaporize the bridge portion 116 into a high temperature plasma.

Referring to FIG. 2, a chemically reactive material 120 (e.g., 1.0 micron) is deposited over at least the bridge portion 116 of the layer 114 of conductive metal, and an overcoat 122 is provided on top of the chemically reactive material 120. For sake of convenience of discussion, the overcoat 122 aligns in register with, and is dimensioned the same as the chemically reactive material 120. With reference to FIG. 1, the chemically reactive material 120 is thus located directly underneath the overcoat 122. In practice, the reactive material 120 and the overcoat 122 need not have the same dimensions.

With reference to FIGS. 1 and 2 generally, the reactive material 120 and overcoat 122 are illustrated as a generally rectangular region that overlies the bridge portion 116. The region may also extend onto the substrate 102, e.g., in the areas adjacent to the bridge portion 116 and adjacent to (i.e., not directly over) the layer 114 of conductive metal.

The reactive material 120 may include zirconium, boron, titanium, combinations thereof, etc. The addition titanium where utilized, can provide additional mass to the bridge portion 116 for plasma formation. For instance, a 0.05 micron layer of titanium may be deposited over the bridge portion 116, and a 1 micron layer of zirconium may be positioned over the titanium. Alternatively, the reactive material may be based upon boron. Still further, other reactive materials may be utilized. The reactive material 120 is configured to experience an exothermic reaction in response to the high temperature plasma created by the bridge portion 116 vaporizing. In this regard, in some embodiments, a layer of a weak-bonded oxide (e.g., copper oxide, iron oxide, etc.) (not shown in FIGS. 1-2) is placed on top of the reactive material 120 to donate oxygen, e.g., to aid in the exothermic reaction. In various embodiments, the weak-bonded oxide is mixed in with the reactive material 120. Further, the reactive material 120 may be layered with other reactive materials. For example, layers of boron can be alternated with layers of zirconium to build the reactive material 120.

As noted above, the overcoat 122 (e.g., 100 microns$^2$) is layer of material that is deposited over the reactive material 120. The overcoat 122 can add additional mass to the reactive semiconductor bridge device and enables the creation of energetic particles that can travel across a gap and ignite an explosive. Depending upon the implementation, there may be an additional layer between the reactive layer 120 and the overcoat 122, e.g., depending upon the selection of materials.

In an illustrative implementation, the overcoat 122 does not include an oxide.

In a further implementation, the overcoat includes an oxide material. In this configuration, the oxide material of the overcoat 122 can be a strong bonded oxide such as, but not limited to, silicon dioxide. Because of the strong bonded oxide, the overcoat 122 is not used up during the exothermic reaction of the reactive layer 120. As such, when the reactive material 120 experiences the exothermic reaction, the oxide material 122 absorbs at least part of the exothermic reaction and breaks into a plurality of particles that are propelled away from the bridge 116 by the exothermic reaction. For instance, where silicon dioxide is utilized, the exothermic reaction may break the silicon dioxide into glass fragments that have mass. In some embodiments, the oxide material absorbs so much of the exothermic reaction that the plurality of particles includes molten particles, e.g., molten glass fragments. The energy from the exothermic reaction projects these molten glass fragments away from the bridge portion 116.

In this regard, a reactive semiconductor bridge device 100 is realized, which includes in general, a pair of electrically conductive pads 118 spaced apart and electrically connected by a bridge portion 116. A reactive material 120 is positioned over the bridge portion such that, in response to the bridge portion turning to plasma, the reactive material 120 experiences an exothermic reaction. An overcoat 122 is positioned over the reactive material 120, which includes a layer of material. In response to the bridge portion turning to plasma, the layer of material absorbs at least a part of the exothermic reaction of the reactive material, and breaks into particles which propel away from the bridge portion. The generated particles have sufficient mass to penetrate a membrane spaced a from the reactive semiconductor bridge by a gap. Moreover, these particles have sufficient thermal mass to retain sufficient energy to transit a gap (e.g., a small air gap), penetrate a membrane, and ignite a primary explosive on the other side of the gap and membrane.

The reactive semiconductor bridge device 100 may be utilized for purposes such as to initiate a shock wave, initiate a combustion event, initiate a detonation event etc. For instance, an exemplary use of the reactive semiconductor bridge device 100 herein is to function an explosive material.

Figure 3:
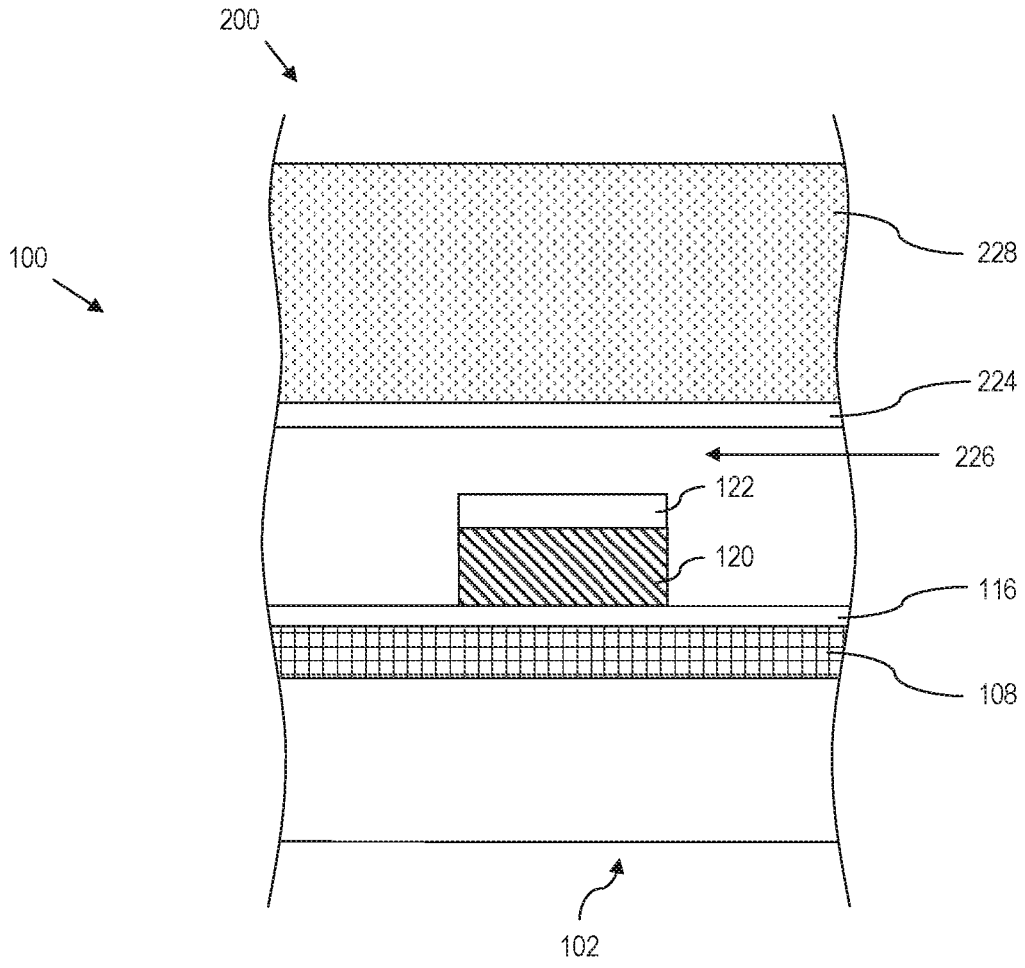
FIG. 3 is a cutout view of a reactive semiconductor bridge with an overcoat in an initiator including a gap and a membrane between the overcoat and a primary explosive, according to various aspects of the present disclosure.

Turning now to FIG. 3, an apparatus 200 comprises the reactive semiconductor bridge device 100 of FIGS. 1 and 2. A membrane 224 is spaced from the reactive semiconductor bridge device 100 by a gap 226. Notably, FIG. 3 only shows a central portion of the reactive semiconductor bridge 100, gap 226, and membrane 224 for sake of clarity of discussion herein.

The gap 226 can be any distance depending on the reactive material 120 (with possible weak-bonded oxide as discussed above) and the voltage placed across the contact pads of the reactive semiconductor bridge device 100. For example, the gap 226 may comprise a distance of approximately 3 millimeters or more. Moreover, the gap 226 may be an air gap, or the gap 226 may be filled by other gasses or gas combinations.

The membrane 224 may be any suitable material (e.g., paper, polymer, etc.) depending upon the application of the apparatus 200. For example, in an illustrative implementation, an explosive material is provided on an opposite side of the membrane 224 as the air gap 226. In this example, the membrane may be paper or other material that reduces the loading requirements of packing the explosive material into a corresponding housing. For instance, a paper membrane may be used to keep the explosive material 228 within a holder (not shown) for attachment to the apparatus 200.

In this example, upon functioning the reactive semiconductor bridge device 100, the bridge portion 116 turns to plasma, creating an exothermic reaction with the reactive material 120. The exothermic reaction causes the overcoat 122 to break apart generating at least one particle that projects away from the bridge portion 116 and penetrates the membrane 224 with sufficient energy to function the explosive material 228.

Here, the explosive material 228 may be a primary explosive material such as lead azide. Alternatively, the explosive material 228 may be independent (free of) a primary explosive. Still further, the explosive material 228 may be a pyrotechnic material, or a secondary explosive material such as Pentaerythritol tetranitrate (PETN). Other materials may alternatively be utilized, depending upon factors such as the force required to penetrate the membrane, the gap, force of the exothermic reaction, etc.

More particularly, when the particles of the overcoat 122 are propelled away from the bridge portion 116 of the reactive semiconductor bridge 100, they cross the gap 226, penetrate (e.g., tear, pierce, perforate, etc.) the membrane 224, and ignite the explosive material 228. In embodiments where the particles are molten particles, e.g., molten glass fragments, the perforation may further include burning through the membrane 224.

As noted above, the overcoat 122 can include an oxide. The addition of the stronger-bonded oxide (e.g., silicon dioxide) to the overcoat creates the plurality of particles that have mass that is sufficient to penetrate the membrane. Notably, a weak-bonded oxide is unable to extend the gap and rupture the membrane with sufficient energy to function a primary explosive, which would cause a misfire in the overall apparatus. In this regard, it is noted that the weak-bonded oxide is consumed in the exothermic event as fuel, which is transformed into energy such as a spark or flame. However, sparks, flames, shock and other forms of energy may not be sufficient to penetrate the membrane 124. On the other hand, the overcoat of the present disclosure can launch particles, e.g., fragments, shards, or other materials that have sufficient mass and energy to puncture through the membrane 224 and still have sufficient energy to function the explosive material 228. Here, the particles may carry significant heat, e.g., molten shards of glass.

An explosive event may be initiated by the initiator embodiments above with the following method (and other embodiments of that method). The initiator receives an initiating voltage signal across the contact pads (e.g., 3-25 volts). The low resistance of the conductive metal bridge (e.g., 0.5-1.5 ohms) converts the voltage into a high current (e.g., 2-50 amps), which vaporizes the bridge portion into a high-temperature plasma. The plasma forces an exothermic reaction in the reactive layer (which may be aided by a weak-bonded oxide) that gets at least partially absorbed in the stronger-bonded oxide layer of the overcoat. The stronger-bonded oxide layer breaks into a plurality of particles (which may be molten) that are propelled by the exothermic reaction away from the bridge portion and across the gap to penetrate the membrane and to ignite the explosive material.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. Aspects of the invention were chosen and described in order to best explain the principles of the invention and the practical application, and to enable others of ordinary skill in the art to understand the invention for various embodiments with various modifications as are suited to the particular use contemplated.

What is claimed is:

1. An apparatus comprising:

a pair of electrically conductive pads spaced apart and electrically connected by a bridge portion;

a reactive material over the bridge portion such that, in response to the bridge portion turning to plasma, the reactive material experiences an exothermic reaction; and an overcoat over the reactive material, wherein the overcoat includes a layer of material comprised of a strong-bonded oxide, wherein:

when installed in a device including a membrane and a gap, the apparatus is spaced from the membrane by the gap;

and in response to the bridge portion turning to plasma, the strong-bonded oxide of the layer of material:

absorbs at least a part of the exothermic reaction of the reactive material; and breaks into particles that are propelled away from the bridge portion such that at least one particle has sufficient mass to penetrate the membrane spaced from the bridge portion by the gap.

2. The apparatus of claim 1, wherein the bridge portion is at least one of aluminum, titanium, or palladium.

3. The apparatus of claim 1, wherein the reactive material is at least one of zirconium or boron.

4. The apparatus of claim 1, wherein:

the strong-bonded oxide of the overcoat comprises silicon dioxide; and the particles are formed from the silicon dioxide as a plurality of molten particles.

5. The apparatus of claim 1, wherein:

the pair of electrically conductive pads spaced apart and electrically connected by the bridge portion comprise a conductive metal such that when a high electrical current passes through the bridge portion, the conductive metal in the bridge portion vaporizes into the plasma.

6. The apparatus of claim 1, wherein:

the gap is at least three millimeters.

7. The apparatus of claim 1 further comprising:

an explosive material on an opposite side of the membrane as the gap, wherein the at least one particle that penetrates the membrane has sufficient energy to detonate the explosive material.

8. The apparatus of claim 7, wherein:

the explosive material is a primary explosive.

9. The apparatus of claim 7, wherein:

the explosive material is free of a primary explosive.

10. The apparatus of claim 1, wherein:

the membrane is paper.

11. A method of initiating an explosive event comprises:

receiving by a reactive semiconductor bridge device, an initiating voltage signal, where the reactive semiconductor bridge device includes:

a pair of electrically conductive pads spaced apart and electrically connected by a bridge portion;

a reactive layer over the bridge portion; and an overcoat over the reactive layer, wherein the overcoat includes a material comprised of a strong-bonded oxide;

wherein the initiating voltage signal is received across the pair of contact pads;

converting the received voltage into a high current passing through the bridge portion so as to vaporize the bridge portion into a high-temperature plasma; and forcing an exothermic reaction by the plasma in the reactive layer such that the exothermic reaction of the reactive layer gets at least partially absorbed in the strong-bonded oxide of the overcoat, such that the strong-bonded oxide of the overcoat breaks into a plurality of particles that are propelled by the exothermic reaction away from the bridge portion.

12. The method of claim 11 further comprising propelling the particles across a gap to penetrate a membrane.

13. The method of claim 11 further comprising propelling the particles across a gap to penetrate a membrane with sufficient energy to detonate an explosive material positioned on the opposite side of the membrane as the gap.

* * * * *